US008325934B2

(12) United States Patent
Kuo

(10) Patent No.: US 8,325,934 B2
(45) Date of Patent: Dec. 4, 2012

(54) ELECTRONIC PILLOW FOR ABATING SNORING/ENVIRONMENTAL NOISES, HANDS-FREE COMMUNICATIONS, AND NON-INVASIVE MONITORING AND RECORDING

(75) Inventor: Sen M. Kuo, DeKalb, IL (US)

(73) Assignee: Board of Trustees of Northern Illinois University, DeKalb, IL (US)

( * ) Notice: Subject to any disclaimer, the term of this patent is extended or adjusted under 35 U.S.C. 154(b) by 1288 days.

(21) Appl. No.: 11/952,250

(22) Filed: Dec. 7, 2007

(65) Prior Publication Data

US 2009/0147965 A1 Jun. 11, 2009

(51) Int. Cl.
*A47C 20/00* (2006.01)

(52) U.S. Cl. ..... 381/71.1; 381/66; 381/71.6

(58) Field of Classification Search ..... 381/71.1–71.14, 381/66

See application file for complete search history.

(56) References Cited

U.S. PATENT DOCUMENTS

| | | | | |
|---|---|---|---|---|
| 3,342,285 | A | 9/1967 | Robbins | |
| 3,998,209 | A | 12/1976 | MacVaugh | |
| 4,941,478 | A | 7/1990 | Takeuchi et al. | |
| 5,133,017 | A * | 7/1992 | Cain et al. | 381/71.6 |
| 5,359,662 | A | 10/1994 | Yuan et al. | |
| 5,444,786 | A | 8/1995 | Raviv | |
| 5,502,770 | A | 3/1996 | Kuo et al. | |
| 5,581,833 | A | 12/1996 | Zenoff | |
| 5,844,996 | A | 12/1998 | Enzmann et al. | |
| 5,940,519 | A | 8/1999 | Kuo | |
| 5,991,418 | A | 11/1999 | Kuo | |
| 6,097,823 | A | 8/2000 | Kuo | |
| 6,182,312 | B1 | 2/2001 | Walpin | |
| 6,198,828 | B1 | 3/2001 | Kuo | |
| 6,418,227 | B1 | 7/2002 | Kuo | |
| 6,668,407 | B1 | 12/2003 | Reitzel | |
| 7,000,273 | B2 | 2/2006 | Rivera-Wienhold et al. | |
| 2001/0031052 | A1 * | 10/2001 | Lock et al. | 381/71.7 |
| 2007/0239225 | A1 | 10/2007 | Saringer | |

(Continued)

FOREIGN PATENT DOCUMENTS

EP 0133195 2/1985

(Continued)

OTHER PUBLICATIONS

Kuo, Sen M. "Real-Time Experiment of Snore Active Noise Control," 16th IEEE International Conference on Control Applications Part of IEEE Multi-conference on Systems and Control Singapore, 1-3, 1342-1346 (2007).

(Continued)

*Primary Examiner* — Ramon Barrera
(74) *Attorney, Agent, or Firm* — Barnes & Thornburg LLP; Alice O. Martin

(57) ABSTRACT

An electronic pillow including a pillow unit encasing at least one error microphone and at least one loudspeaker in electrical connection with a controller unit, the pillow unit also including a power source, and a reference sensing unit including at least one reference microphone in electrical connection with the controller unit, the controller unit including an algorithm for controlling interactions between the error microphone, loudspeaker, and reference microphone. A method of abating unwanted noise, by detecting an unwanted noise with a reference microphone, analyzing the unwanted noise, producing an anti-noise corresponding to the unwanted noise in a pillow, and abating the unwanted noise. Methods of hands-free communication, recording and monitoring sleep disorders, providing real-time response to emergencies, and playing audio sounds.

15 Claims, 7 Drawing Sheets

U.S. PATENT DOCUMENTS

2009/0147965 A1 6/2009 Kuo

FOREIGN PATENT DOCUMENTS

JP H08-083080 3/1996
JP 08140807 A * 6/1996
JP 2007089814 A * 4/2007

OTHER PUBLICATIONS

Chakravarthy, Sreeram R. et al., "Application of Active Noise Control for Reducing Snore," V-305-308 (2006) JCASSP.
Kuo, Sen M. et al., "Active Noise Control: A Tutorial Review," Proceedings of the IEEE, vol. 87, No. 6, 943-973 (1999).
Das et al., "New Block Filtered-X LMS Algorithms for Active Noise Control Systems," *IET Signal Processing,* 1(2): 73-81 (2007).
Gan et al., "Adaptive Feedback Active Noise Control Headsets: Implementation, Evaluation and Its Extensions" *IEEE Trans. on Consumer Electronics,* 51(3): 975-982 (2005).
Gan et al., "An Integrated Audio and Active Noise Control Headsets," *IEEE Trans. on Consumer Electronics,* 48(2): 242-247 (2002).
Gan et al., "Audio Projection: Directional Sound and its Application in Immersive Communication," *IEEE Signal Processing Magazine,* 29(1): 43-57 (2011).
Gan et al., "Embedded Signal Processing with the Micro Signal Architecture," John Wiley & Sons, Hoboken, NJ, pp. v-xix (2007).
Gan et al., "Teaching DSP Software Development: From Design to Fixed-Point Implementations," *IEEE Trans. on Education,* 49(1): 122-131 (2006).
Gan et al., "Transition from Simulink to MATLAB in Real-Time Digital Signal Processing Education," *International Journal on Engineering Education,* 21(3): 587-595 (2005).
Gan et al., "Virtual Bass for Home Entertainment, Multimedia PC, Game Station and Portable Audio Systems," *IEEE Trans. on Consumer Electronics,* 47(4): 787-794 (2001).
Greenwood et al. "Implementation of the Fractal-Based Random-Iterated Function System Decoding on the AT&T DSP32C," Chapter 4 in Progress in Computer Graphics, Edited by C. Sabharwal and G. Zobrist, pp. 127-163, Ablex Publishing Co., Norwood, NJ, 1992.
Gupta et al., "Active Vibration Control of a Structure by Implementing Filtered-X LMS Algorithm for Active Vibration Control," *Noise Control Engineering Journal,* 54(6): 396-405 (2006).
Gupta et al., "Digital Implementation of Active Vibration Control of a Structure," *Journal of Low Frequency Noise, Vibration and Active Control,* 26(2): 135-141 (2007).
Jeon et al., "A Narrowband Active Noise Control System with Frequency Corrector," *IEEE Trans. Audio, Speech and Language Processing,* 19(4): 990-1002 (2011).
Jeon et al., "Analysis of Frequency Mismatch in Narrowband Active Noise Control," *IEEE Trans. Audio, Speech and Language Processing,* 18(6): 1632-1642 (2010).
Kong et al., "Analysis of Asymmetric Out-of-Band Overshoot in Narrowband Active Noise Control Systems," *IEEE Trans. on Speech Audio Processing,* 7(5): 587-591 (1999).
Kong et al., "Multiple Channel Hybrid Active Noise Control Systems," *IEEE Trans. on Control Systems Technology,* 6(6): 719-729 (1998).
Kong et al., "Study of Causality Constraint on Feed-forward Active Noise Control Systems," *IEEE Trans. on Circuits and Systems,* 46(2): 183-186 (1999).
Kuo et al, "Active Noise Control Systems—Algorithms and DSP Implementations," John Wiley & Sons, New York, NY (1996).
Kuo et al., "A Secondary Path Modeling Technique for Active Noise Control Systems," *IEEE Trans. on Speech and Audio Processing,* 5(4): 374-377 (1997).
Kuo et al., "Acoustic Noise and Echo Cancellation Microphone System for Videoconferencing," *IEEE Trans. on Consumer Electronics,* 41(4): 1150-1158 (1995).
Kuo et al., "Acoustical Mechanisms and Performance of Various Active Duct Noise Control Systems," *Applied Acoustics,* 41(1): 81-91 (1994).
Kuo et al., "Active Noise Control System for Headphone Applications," *IEEE Trans. on Control Systems Technology,* 14(2): 331-335 (2006).
Kuo et al., "Active Noise Control System with Parallel On-Line Error-Path Modeling Algorithm," *Noise Control Engineering Journal,* Institute of Noise Control Engineering, 39(3): 119-127 (1992).
Kuo et al., "Active Noise Control," Chapter 49 in Springer Handbook of Speech Processing and Speech Communications, Edited by J. Benesty, Y. Huang, and M. Sondhi, pp. 1001-1017, Berlin Heidelberg: Springer-Verlag, 2008.
Kuo et al., "Active Noise Control: A Tutorial Review," *Proceedings of the IEEE,* 87(6): 943-973 (1999).
Kuo et al., "Active Snore Noise Control Systems," *Noise Control Engineering Journal,* 56(1): 16-24 (2008).
Kuo et al., "Adaptive Acoustic Echo Cancellation Microphone," *Journal of Acoustical Society of America,* 93(3): 1629-1636 (1993).
Kuo et al., "Adaptive Active Noise Control Systems," Chapter 2 in Digital Signal Processing Technology, Edited by P. Papamichalis and R. Kerwin, vol. CR57, pp. 23-49, SPIE Press, Bellingham, Washington, 1995.
Kuo et al., "Adaptive Algorithms and Experimental Verification of Feedback Active Noise Control Systems," *Noise Control Engineering Journal,* 42(2): 37-46 (1994).
Kuo et al., "Adaptive Noise and Acoustic Echo Cancellation Techniques for the Hands-Free Cellular Phone System," *Applied Signal Processing,* 1: 217-227 (1994).
Kuo et al., "An Acoustic Echo Canceler Adaptable During Double-Talk Periods Using Two Microphones," *Acoustics Letters,* 15(9): 175-178 (1992).
Kuo et al., "An Innovative Course Emphasizing Real-Time Digital Signal Processing Applications," *IEEE Trans. on Education,* 39(2): 109-113 (1996).
Kuo et al., "Analysis of Finite Length Acoustic Echo Cancellation System," *Speech Communication,* European Association for Signal Processing and European Speech Communication Association, 16(3): 255-260 (1995).
Kuo et al., "Applications of Adaptive Feedback Active Noise Control System," *IEEE Trans. on Control Systems Technology,* 11(2) : 216-220 (2003).
Kuo et al., "Broadband Adaptive Noise Equalizer," *IEEE Signal Processing Letters,* 3(8): 234-235 (1996).
Kuo et al., "Convergence Analysis of Narrowband Active Noise Control Systems," *IEEE Trans. on Circuits and Systems—I: Analog and Digital System Processing,* 46(2): 220-223 (1999).
Kuo et al., "Design of Active Noise Control Systems with the TMS320 Family," Application Book, Texas Instruments, SPRA042 (1996).
Kuo et al., "Development and Analysis of An Adaptive Noise Equalizer," *IEEE Trans. on Speech and Audio Processing,* 3(3): 217-222 (1995).
Kuo et al., "Development and Analysis of Distributed Acoustic Echo Cancellation Microphone System," *Signal Processing,* European Association for Signal Processing, 37(3): 333-344 (1994).
Kuo et al., "Development and Application of Audio-Integrated Active Noise Control System for Infant Incubators," *Noise Control Engineering Journal,* 58(2): 163-175 (2010).
Kuo et al., "Development and Experiment of Narrowband Active Noise Equalizer," *Noise Control Engineering Journal,* 41(1): 281-288 (1993).
Kuo et al., "Development of Adaptive Algorithm for Active Sound Quality Control," *Journal of Sound and Vibration,* 299: 12-21 (2007).
Kuo et al., "Digital Hearing Aid with the Lapped Transform," *Digital Signal Processing,* 3(4): 228-239 (1993).
Kuo et al., "Digital Signal Processors: Architectures, Implementations, and Applications," Prentice Hall, Upper Saddle River, NJ (2005).
Kuo et al., "Distributed Acoustic Echo Cancellation System With Double-Talk Detector," *Journal of Acoustical Society of America,* 94(6): 3057-3060 (1993).
Kuo et al., "Dual-Channel Audio Equalization and Cross-Talk Cancellation for 3-D Sound Reproduction," *IEEE Trans. on Consumer Electronics,* 43(4): 1189-1196 (1997).

Kuo et al., "Effects of Frequency Separation in Periodic Active Noise Control Systems," *IEEE Trans. on Audio, Speech, and Language Processing,* 14(5): 1857-1866 (2006).
Kuo et al., "Frequency-Domain Delayless Active Sound Quality Control Algorithms," *Journal of Sound and Vibration,* 318: 715-724 (2008).
Kuo et al., "Frequency-Domain Periodic Active Noise Control and Equalization," *IEEE Trans. on Speech and Audio Processing,* 5(4): 348-358 (1997).
Kuo et al., "Implementation of Adaptive Filtering with the TMS320C25 or the TMS320C30," Chapter 7 in Digital Signal Processing Applications with the TMS320 Family, Edited by P. Papamichalis, vol. III, pp. 191-271, Prentice-Hall, Englewood Cliffs, NJ 1990.
Kuo et al., "Integrated Automotive Signal Processing and Audio System," *IEEE Trans. on Consumer Electronics,* 39(3): 522-532 (1993).
Kuo et al., "Integrated Frequency-Domain Digital Hearing Aid with the Lapped Transform," *Electronics Letters.* 28(23): 2117-2118 (1992).
Kuo et al., "Multipath Acoustic Echo Canceler with New PAP Structure and TW-LMS Algorithm," *Acoustic Letters,* 16(12): 270-273 (1993).
Kuo et al., "Multiple Reference Subband Adaptive Noise Canceler for Hands-free Cellular Phone Applications," *Journal of the Franklin Institute,* 333(B)(5): 669-686 (1996).
Kuo et al., "Multiple-Microphone Acoustic Echo Cancellation System with the Partial Adaptive Process," *Digital Signal Processing,* 3(1): 54-63 (1993).
Kuo et al., "Narrowband Active Noise Control Using Adaptive Delay Filter," *IEEE Signal Processing Letters,* 5(12): 309-311 (1998).
Kuo et al., "New Adaptive IIR Notch Filter and Its Application to Howling Control in Speakerphone System," *Electronics Letters,* 28(8): 764-766 (1992).
Kuo et al., "Nonlinear Adaptive Bilinear Filters for Active Noise Control Systems," *IEEE Trans. on Circuits and Systems, Part I: Regular Papers,* 52(3): 617-624 (2005).
Kuo et al., "On-Line Modeling and Feedback Compensation for Multiple-Channel Active Noise Control Systems," *Applied Signal Processing,* 1(2): 64-75 (1994).
Kuo et al., "Parallel Adaptive On-Line Error-Path Modeling Algorithm for Active Noise Control System," *Electronics Letters,* 28(4): 375-377 (1992).
Kuo et al., "Passband Disturbance Reduction in Periodic Active Noise Control System," *IEEE Trans. on Speech and Audio Processing,* 4(2): 96-103(1996).
Kuo et al., "Performance Analysis of Acoustic Echo Cancellation Microphone," *Acoustics Letters,* 16(7): 151-156 (1993).
Kuo et al., "Principle and Application of Adaptive Noise Equalizer," *IEEE Trans. on Circuits and Systems,* 41(7): 471-474 (1994).
Kuo et al., "Principle and Applications of Asymmetric Crosstalk-Resistant Adaptive Noise Canceler," *Journal of the Franklin Institute,* 337: 57-71 (2000).
Kuo et al., "Real-Time Digital Signal Processing: Implementations and Applications," John Wiley & Sons, West Sussex (2006).
Kuo et al., Real-Time Digital Signal Processing: Implementations, Applications, and Experiments with the TMS320C55x, John Wiley & Sons, Chichester, (2001).
Kuo et al., "Residual Noise Shaping Technique for Active Noise Control Systems," *Journal of Acoustical Society of America,* 95(3): 1665-1668 (1994).
Kuo et al., "Saturation Effects in Active Noise Control Systems," *IEEE Trans. on Circuits and Systems, Part I: Regular Papers,* 51(6): 1163-1171 (2004).
Kuo et al., "Three-Stage Algorithm for Transformer Active Noise Control," *Applied Signal Processing,* 4(1): 27-38 (1997).
Lee et al., "Subband Adaptive Filtering: Theory and Implementation," John Wiley & Sons, West Sussex, (2009).
Liu et al., "Active Noise Control for Motorcycle Helmet," *International Journal of Information and Communication Engineering,* 6(2): 103-108 (2010).
Liu et al., "An Audio Integrated Motorcycle Helmet," *J. of Low Frequency Noise, Vibration and Active Control,* 29(3): 161-170 (2010).
Liu et al., "Real-time Experiments of ANC Systems for Infant Incubators," *Noise Control Engineering Journal,* 60(1): 36-41 (2012).
Liu et al., "Still in Womb: Intrauterine Acoustic Embedded Active Noise Control for Infant Incubators," *Advances in Acoustics and Vibration,* 2008: Article ID 495317 (2008).
Song et al., "A Robust Hybrid Feedback Active Noise Cancellation Headset," *IEEE Trans. on Speech and Audio Processing,* 13(4) 607-617 (2005).
Sun et al., "Active Narrowband Noise Control Systems Using Cascading Adaptive Filters," *IEEE Trans. on Audio, Speech, and Language Processing,* 15(2): 586-592 (2007).
Sun et al., "Adaptive Algorithm for Active Control of Impulsive Noise," *Journal of Sound and Vibration,* 291: 516-522 (2006).
Wang et al., "Integration of Bass Enhancement and Active Noise Control System in Automobile Cabin," *Advances in Acoustics and Vibration,* 2008: Article ID 869130 (2008).
Wu et al., "Teaching Challenge in Hands-on DSP Experiments for Night-School Students," *EURASIP Journal on Advances in Signal Processing,* 2008: Article ID 570896 (2008).
Yang et al., "Analysis of Narrowband Active Noise and Vibration Control Systems Using Parallel Adaptive Notch Filters," *Journal of Vibration and Control,* 14(7): 931-951 (2008).
International Search Report issued in PCT/US2008/085293 dated Jan. 29, 2009.
Supplementary European Search Report issued in EP08856447 dated Apr. 5, 2011.
Office Action issued in Japanese Patent App. No. 2010-537019 (Aug. 14, 2012).

* cited by examiner

ELECTRONIC PILLOW FOR ABATING SNORING/ENVIRONMENTAL NOISES, HANDS-FREE COMMUNICATIONS, AND NON-INVASIVE MONITORING AND RECORDING

BACKGROUND OF THE INVENTION (1) Field of the Invention

The present invention relates to an electronic pillow. In particular, the present invention relates to an electronic pillow including active noise control, acoustic echo cancellation, and recording and monitoring devices.

(2) Description of Related Art

Snoring is an acoustic phenomenon generated by vibrating tissue structures due to obstruction in the upper airway during sleep, and is a prominent problem in modern society. The U.S. National Commission on Sleep Disorders Research estimates that 74 million Americans snore every night, and 38% of Americans who are disturbed by snoring, suffer from daytime fatigue. The annoying intermittent nature of snoring disrupts the sleep of the snorer's bed partner, causing stress and social nuisance. The sleep disruption has been linked to excessive daytime sleepiness of the snorer and his/her bed partner. This can result in loss of productivity in the work environment and lead to occupational accidents, or even reduce one's ability to safely operate a car.

With ever-increasing air and ground traffic noise pollution, reducing noise continues to be a challenge for communities to maintain and increase the quality of life. The growth of high-density housing increases the exposure of populations to traffic noise sources, and the cost constraints have resulted in a tendency to use lighter materials for automobile and building, which results in an increase in environmental noise. There is a lack of technique for effective design for reducing indoor noise pollution in urban areas.

For low-frequency snoring/environmental noise, passive methods such as earmuffs or earplugs are either ineffective or uncomfortable to wear during sleep. Several noise cancellation methods have been developed to reduce the noise of snoring utilizing active noise control (ANC). These ANC systems are based on the principle of superposition to attenuate low-frequency primary (unwanted) noise using secondary anti-noise of the same magnitude but opposite phase. By ANC, the anti-noise and the unwanted noise are both canceled out. Since the characteristic of the noise source and the environment are time varying, most practical ANC systems are adaptive in nature. Acoustic ANC finds numerous applications in reducing low-frequency noises without the change of existing installation and configuration in rooms.

U.S. Pat. No. 5,844,996 to Enzmann, et al. discloses a system for canceling involuntary noises from the airway of a human being, such as snoring. Loudspeakers are mounted on the headboard of a bed to provide noise cancellation, and a microphone is mounted in close proximity to the snorer's head to detect noises from the snorer. The non-snoring sleeper must wear error microphones near their ear in the form of a patch. It is both uncomfortable and inconvenient for the non-snoring sleeper to wear these microphones while sleeping. Furthermore, this design requires that a bed have a headboard, an added expense for users. Also, the distance of the loudspeakers from the non-snoring sleeper requires a greater amount of noise cancellation, i.e. the noises produced by the loudspeakers must be loud enough to reach the sleeper on the bed. This also results in higher volume of acoustic feedback from the loudspeakers to the reference microphone. It would be advantageous to reduce the volume of required canceling noise by placing the loudspeakers close to the non-snoring sleeper.

Kuo, et al. (*IEEE Int. Conf. on Control Applications*, October 2007, pp. 1342-1346) and Chakravarthy, et al. (*Proc. IEEE ICASSP*, May 2006, pp. 305-308) both disclose a system to reduce the snoring noise level at the snorer's bed partner's head location based on ANC techniques. The loudspeakers and error microphones are mounted on the headboard of the bed, thus eliminating the requirement of the sleeper to wear microphones. However, again this system requires that the bed have a headboard, and this system requires actual modification of the headboard with added installation costs. This can also be disadvantageous because not all headboards may be easily modified. Also, once mounted, the system does not look aesthetically pleasing and can even be scary for someone trying to sleep surrounded by all of the equipment. In addition, this also results in higher volume of acoustic feedback from the loudspeakers to the reference microphone.

Therefore, there is a need for a system for reducing snoring noises that is aesthetically pleasing, is convenient and moveable for the user, and does not require excessive noise to accomplish the noise abatement.

Speakerphones and hands-free phones have become important equipment for providing the convenience of hands-free communication, especially for handicapped individuals or patients in hospital beds who may not be able to operate a phone or hold a phone up to their ear. Therefore, it would be advantageous to have a hands-free communications device for use when lying in bed or sitting in a chair.

Many people with sleeping disorders go to a sleep lab to be diagnosed with a particular disorder so that they can seek treatment. Many times being in a different environment than one's own home can disrupt sleep. It would be advantageous to provide non-invasive detection of sleep disorders wherein that detection can occur in one's own home.

BRIEF SUMMARY OF THE INVENTION

The present invention provides for an electronic pillow including a pillow unit, a controller unit, and a sensing unit. The pillow unit encases at least one error microphone and at least one loudspeaker in electrical connection with a controller unit, and a reference sensing unit includes at least one reference microphone in electrical connection with the controller unit. The controller unit includes a power source and an algorithm for controlling interactions between the error microphone, the loudspeaker, and the reference microphone.

The present invention also includes a pillow mechanism for active noise control of unwanted noises.

The present invention further includes a method of abating unwanted noise by detecting an unwanted noise with a reference microphone, analyzing the unwanted noise, producing an anti-noise corresponding to the unwanted noise in a pillow, and abating the unwanted noise.

The present invention includes a method of hands-free communication by sending and receiving sound waves through a pillow in connection with a phone interface.

The present invention includes a method of recording and monitoring sleep disorders, by recording sound produced by a sleeper with microphones encased within a pillow.

The present invention also includes a method of providing real-time response to emergencies, including the steps of detecting a noise with a reference microphone in a pillow, analyzing the noise, and providing real-time response to an emergency indicated by the analyzed noise.

The present invention further includes a method of playing audio sound in the pillow described above, including the step of playing audio sound through the loudspeakers of the pillow unit.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
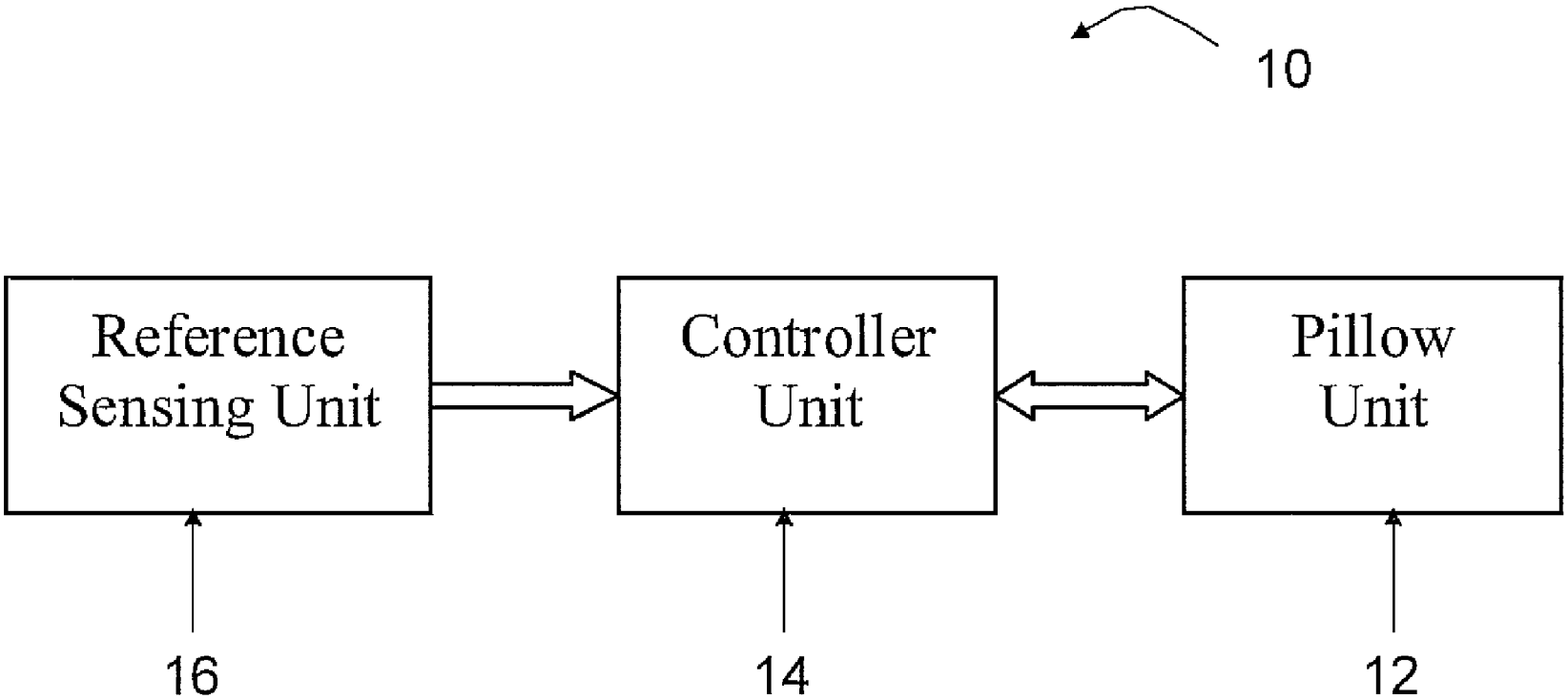
FIG. 1 is a block diagram of the electronic pillow including a pillow unit, controller unit, and reference sensing unit.

In general, the present invention is an electronic pillow shown at 10 in the figures. The electronic pillow 10 includes three main units: a pillow unit 12 in electrical connection with a controller unit 14 and a reference sensing unit 16, shown generally in FIG. 1. The electronic pillow 10 can be used in a variety of applications detailed herein and preferably for ANC applications such as snore reduction. The electronic pillow 10 can be portable and unlike prior art ANC devices, it can be used in different bedrooms, different sides of the bed, and enables the user to receive the benefits of the pillow when traveling.

The pillow unit 12 is more generally a pillow 18 that can be any size desired to fit different sizes of pillowcases, thus the pillow 18 can match any bed. The pillow 18 can alternatively be in the form of a headrest for a chair depending on the use of the electronic pillow 10. For example, the pillow 18 can be a headrest for a chair in the home (an armchair), a plane seat, a train seat, or a car seat when being used for hands-free communications. The pillow 18 can be portable as described above and designed to be attachable to a chair, or it can be built directly into the chair as the headrest. Preferably, the pillow 18 is made of memory foam, but other fillers can also be used. The pillow 18 also encases at least one error microphone 20 and at least one loudspeaker 22 that are in electrical connection with the controller unit 14 as shown in FIG. 2.

Figure 2:
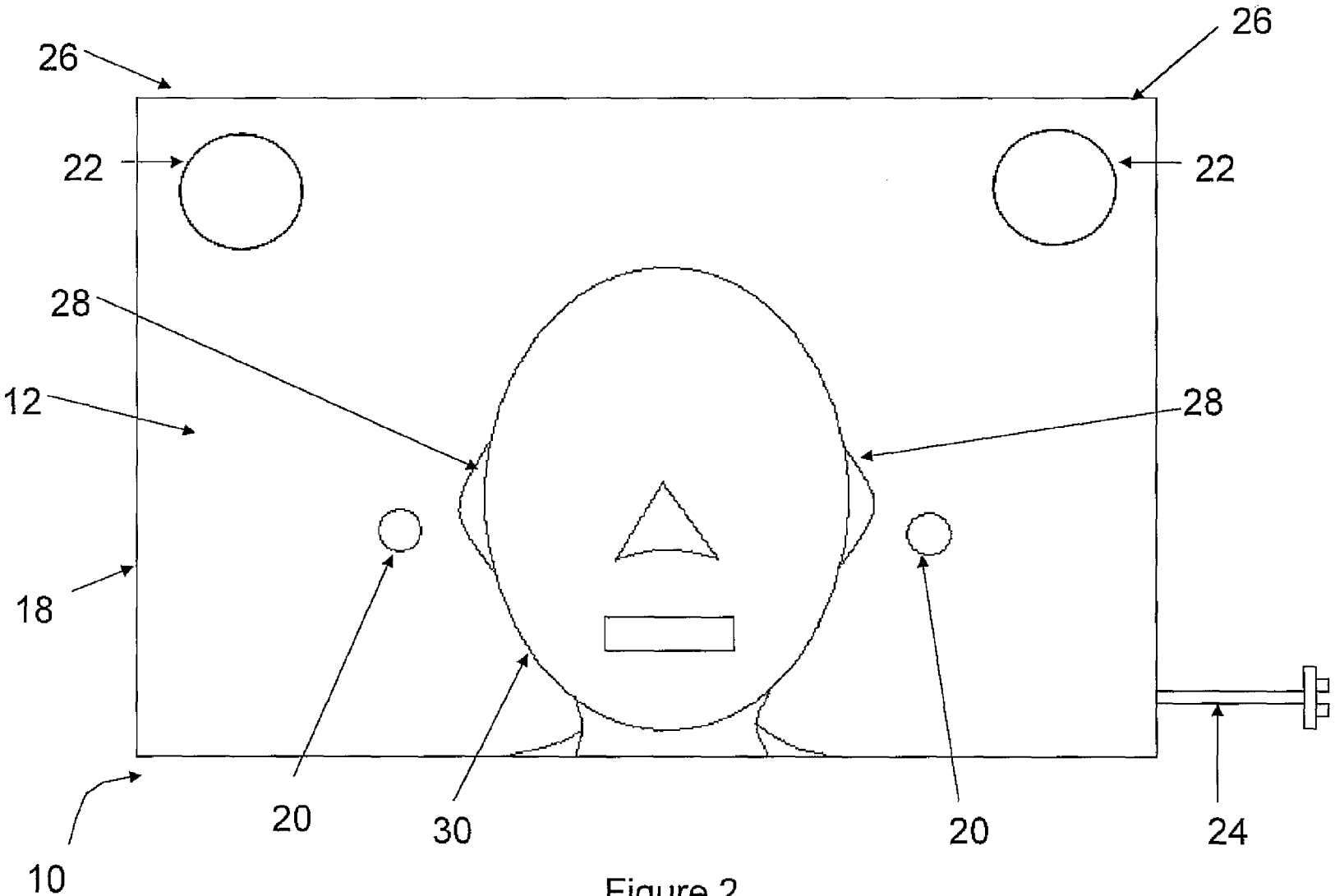
FIG. 2 is a photograph of the electronic pillow and pillow unit.

Preferably, there are two error microphones 20 encased by the pillow 18, each positioned to be close to ears 28 of a user 30 as shown in FIG. 2. The error microphones 20 detect various signals or noises created by the user 30 and relay these signals to the controller unit 14 for processing. For example, the error microphones 20 can detect speech sounds from the user when the electronic pillow 10 is used as a hands-free communication device. The error microphones 20 also can detect noises that the user 30 hears, such as snoring or other environmental noises when the electronic pillow 10 is used for ANC. The quiet zone created by ANC is centered at the error microphones 20. Placing the error microphones 20 inside the pillow 18 below the user's 30 ears 28, generally around a middle third of the pillow 18, guarantees that the user 30 is close to the center of a quiet zone that has a higher degree of noise reduction than the prior art.

Preferably, there are two loudspeakers 22 encased by the pillow 18, each in an upper back corner 26 of the pillow 18 relatively close to the user's 30 ears 28 as shown in FIG. 2. More or fewer loudspeakers 22 can be used depending on the desired function of the electronic pillow 10. The loudspeakers 22 function to produce various sounds. For example, the loudspeakers 22 can produce speech sound when electronic pillow 10 acts as a hands-free communication device, the loudspeakers 22 can produce a warning sound when the electronic pillow 10 acts as a medical monitoring device, the loudspeakers 22 can produce anti-noise to abate any undesired noise, or the loudspeakers 22 can produce audio sound for entertainment or masking of residual noise. Preferably, the loudspeakers 22 are small enough so as not to be noticeable by the user 30 when resting upon the pillow 18.

There are advantages to placing the loudspeakers 22 inside the pillow 18 relatively close to ears 28 of a user. The level of sound and anti-noise generated by the loudspeakers 22 are reduced compared to prior art devices, in which loudspeakers are placed above a user on a headboard of a bed. Lower noise levels also reduce power consumption and reduce undesired acoustic feedback from the loudspeakers 22 back to the reference sensing unit 16.

Figure 3:
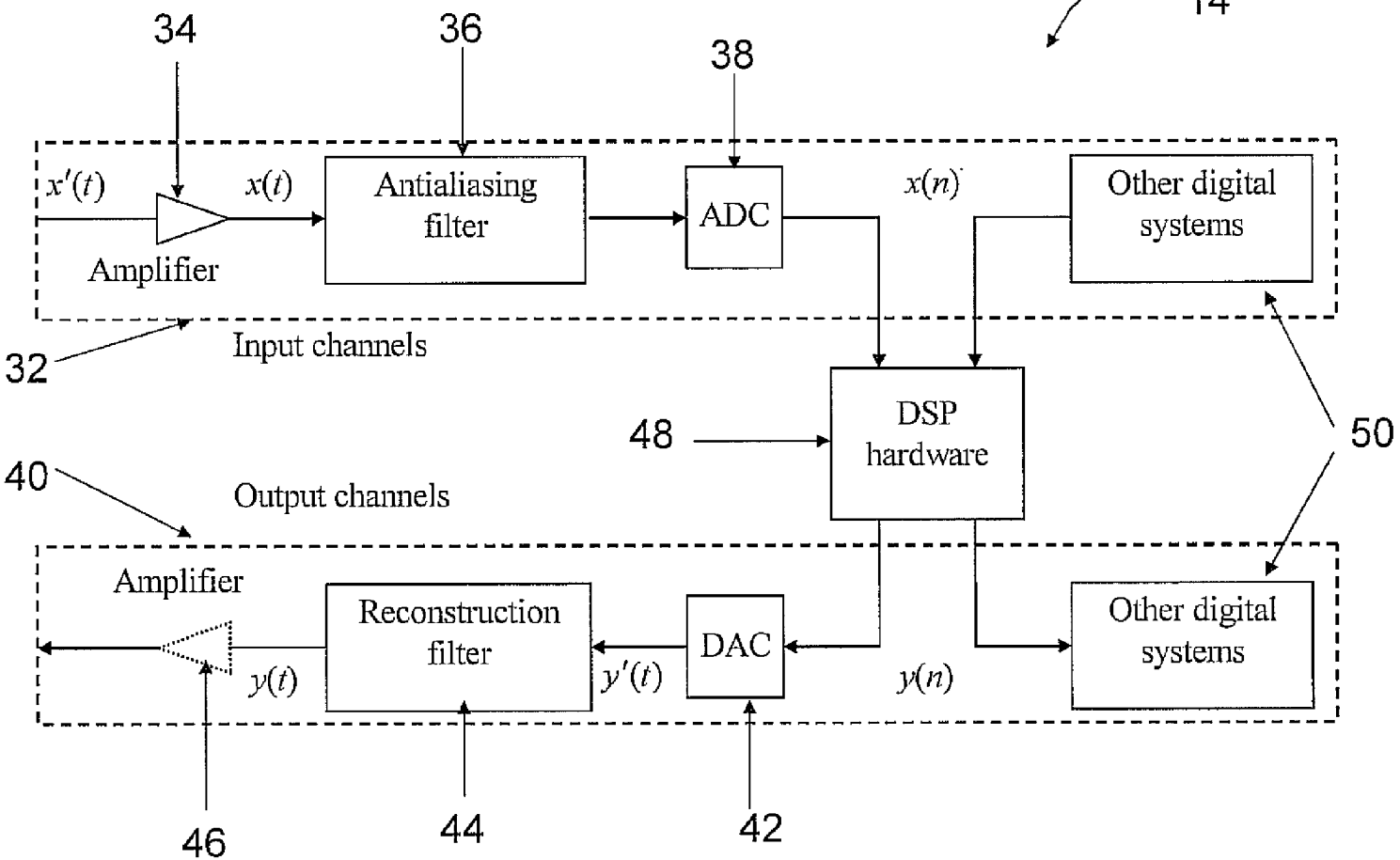
FIG. 3 is a block diagram of a controller unit.

The controller unit 14 is a signal processing unit for sending and receiving signals as well as processing and analyzing signals as shown in FIG. 3. The controller unit 14 includes various processing components such as, but not limited to, a power supply, amplifiers, computer processor with memory, and input/output channels. The controller unit 14 can optionally be enclosed by the pillow 18, or it can be located outside of the pillow 18.

The controller unit 14 further includes a power source 24. The power source 24 can be AC such as a cord to plug into a wall socket or battery power such as a rechargeable battery pack.

There is at least one input channel 32. The number of input channels 32 is equal to the total number of error microphones 20 in the pillow unit 12 and reference microphones 52 in the reference sensing unit 16. The input channels 32 are analog, and include signal conditioning circuitry, a preamplifier 34 with adequate gain, an anti-aliasing lowpass filter 36, and an analog-to-digital converter (ADC) 38. The input channels 32 receive signals (or noise) from the error microphones 20 and the reference microphones 52.

There is at least one output channel 40. The number of output channels 40 is equal to the number of loudspeakers 22 in the pillow unit 12. The output channels 40 are analog, and include a digital-to-analog converter (DAC) 42, smoothing (reconstruction) lowpass filter 44, and power amplifier 46 to drive the loudspeakers 22. The output channels 40 send a signal to the loudspeakers 22 to make sound.

A digital signal processing unit (DSP) 48 generally includes a processor with memory. The DSP receives signals from the input channels 32 and sends signals to the output channels 40. The DSP can also interface (i.e. input and output) with other digital systems 50, such as, but not limited to, audio players for entertainment, digital storage devices for sound recording and phone interfaces for hands-free communications.

The DSP also includes an algorithm for operation of the electronic pillow 10. In general, the algorithm controls interactions between the error microphones 20, the loudspeakers 22, and reference microphones 52. Preferably, the algorithm is one of (a) multiple-channel broadband feedforward active noise control for reducing noise, (b) adaptive acoustic echo cancellation for hands-free communication, (c) signal detection to avoid recording silence periods and sound recognition for non-invasive detection, or (d) integration of active noise control and acoustic echo cancellation. Each of these algorithms are described more fully below in the Examples. The DSP can also include other functions such as non-invasive monitoring using microphone signals and an alarm to wake the user 30 up or call caregivers for emergency situations.

Figure 4:
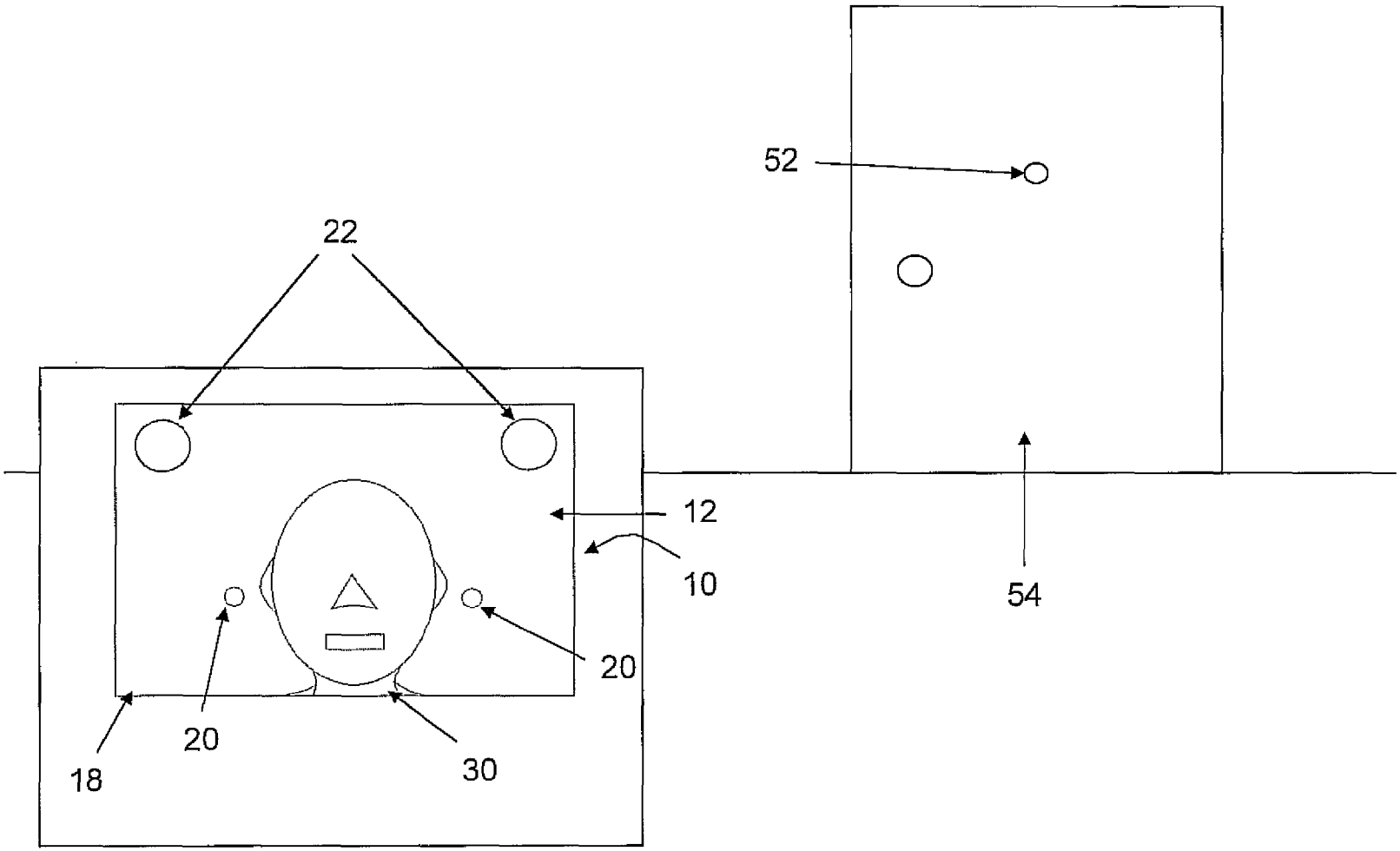
FIG. 4 is a drawing of the electronic pillow with the reference sensing unit.

The reference sensing unit 16 includes at least one reference microphone 52. Preferably, the reference microphones 52 are wireless for ease of placement, but they can also be wired. The reference microphones 52 are used to detect the particular noise that is desired to be abated and are therefore placed near that sound. For example, if the user 30 of the electronic pillow 10 wants to abate noises from other rooms that can be heard through their bedroom door 54, the reference microphone 52 can be placed directly on the bedroom door 54 as shown in FIG. 4. The reference microphone 52 can be placed near a snorer to abate a snoring noise, such as on the snorer's pillow, the snorer's blanket, on the wall above the snorer, or any other suitable place. If the pillow 18 is a headrest, the reference microphone 52 can be placed near any source of noise, or generally around the user 30 such as on the ceiling of a plane or car.

The electronic pillow 10 can be used for a variety of methods in conjunction with the algorithms. For example, the electronic pillow can be used in a method of abating unwanted noise by detecting an unwanted noise with a reference microphone, analyzing the unwanted noise, producing an anti-noise corresponding to the unwanted noise in a pillow, and abating the unwanted noise. Again, the reference microphone(s) 52 are placed wherever the noise to be abated is located. These reference microphones 52 detect the unwanted noise and the error microphones 20 detect the unwanted noise levels at the user's 30 location, both microphones 52 and 20 send signals to the input channels 32 of the controller unit 14, the signals are analyzed with an algorithm in the DSP, and signals are sent from the output channels 40 to the loudspeakers 22. The loudspeakers 22 then produce an anti-noise that abates the unwanted noise. With this method, the algorithm of multiple-channel broadband feedforward active noise control for reducing noise is used to control the electronic pillow 10, described in Example 1.

The electronic pillow 10 can also be used in a method of hands-free communication by sending and receiving sound waves through a pillow in connection with a phone interface. The method operates essentially as described above; however, the error microphones 20 are used to detect speech and the loudspeakers are used to broadcast speech of the person that the user 30 is talking to. With this method, the algorithm of adaptive acoustic echo cancellation for hands-free communications is used to control the electronic pillow 10, as described in Example 2, and this algorithm can be combined with active noise control as described in Example 4.

The electronic pillow can be used in a method of recording and monitoring sleep disorders, by recording noises produced by a sleeper with microphones encased within a pillow. Again, this method operates essentially as described above; however, the error microphones 20 are used to record sounds of the user 30 to diagnose sleep disorders. With this method, the algorithm of signal detection to avoid recording silence periods and sound recognition for non-invasive detection is used to control the electronic pillow 10, as described in Example 3.

The electronic pillow can further be used in a method of providing real-time response to emergencies by detecting a noise with a reference microphone in a pillow, analyzing the noise, and providing real-time response to an emergency indicated by the analyzed noise. The method is performed essentially as described above. Certain noises detected are categorized as potential emergency situations, such as, but not limited to, the cessation of breathing, extremely heavy breathing, choking sounds, and cries for help. Detecting such a noise prompts the performance of real-time response action, such as waking up the user 30 by producing a noise with the loudspeakers 22, or by notifying caregivers or emergency responders of the emergency. Notification can occur in conjunction with the hands-free communications features of the electronic pillow 10, i.e. by sending a message over telephone lines, or by any other warning signals sent to the caregivers.

The electronic pillow can also be used in a method of playing audio sound by playing audio sound through the loudspeakers 22 of the pillow unit 12. The audio sound can be any sound that the user 30 wants to hear, such as soothing music or nature sounds. The audio sound can also be sound from a television, stereo, entertainment system, or computer. This method can also be used to abate unwanted noise, as the audio sound masks snoring and environmental noises. Also, by embedding the loudspeakers 22 inside the pillow unit 12, lower volume can be used to play the audio sound, thus causing less interference with another bed partner.

The invention is further described in detail by reference to the following experimental examples. These examples are provided for the purpose of illustration only, and are not intended to be limiting unless otherwise specified. Thus, the present invention should in no way be construed as being limited to the following examples, but rather, be construed to encompass any and all variations which become evident as a result of the teaching provided herein.

EXAMPLES

Example 1

Multiple-Channel Broadband Feedforward Active Noise Control

Figure 5:
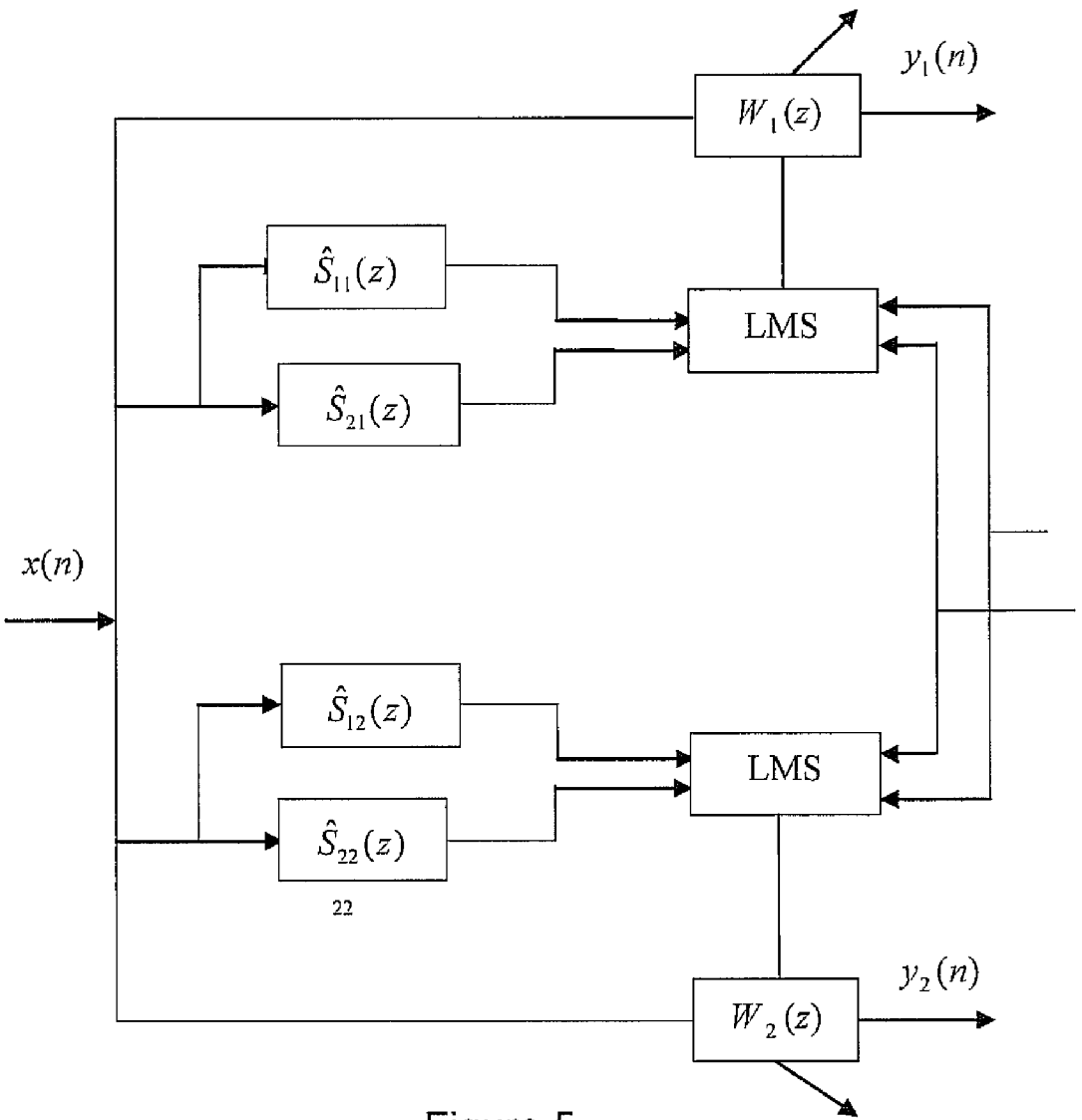
FIG. 5 is diagram of a multiple-channel feedforward ANC system using adaptive FIR filters with the 1×2×2 FXLMS algorithm.

A multiple-channel feedforward ANC system uses one reference microphone, two loudspeakers and two error microphones independently. The multiple-channel ANC system uses the adaptive FIR filters with the 1×2×2 FXLMS algorithm [1] is shown in FIG. 5. The reference signal x(n) is sensed by reference microphones in the reference sensing unit. Two error microphones (located in the pillow unit) obtain the error signals $e_1(n)$ and $e_2(n)$, and the system is thus able to form two individual quiet zones centered at the error microphones that are close to the ears of sleeper. The ANC algorithm used two adaptive filters $W_1(z)$ and $W_2(z)$ to generate two anti-snores $y_1(n)$ and $y_2(n)$ to drive the two independent loudspeakers (also embedded inside the pillow unit). In FIG. 5, $\hat{S}_{11}(z)$, $\hat{S}_{12}(z)$, $\hat{S}_{21}(z)$, and $\hat{S}_{22}(z)$ are the estimates of the secondary path transfer functions using both on-line or offline secondary path modeling techniques described in [1].

The 1×2×2 FXLMS algorithm is summarized as follows [1]:

$$y_i(n)=w_i^T(n)\times(n),\ i=1,2 \tag{1}$$

$$w_1(n+1)=w_1(n)+\mu_1[e_1(n)\times(n)*\hat{s}_{11}(n)+e_2(n)\times(n)*\hat{s}_{21}(n)] \tag{2}$$

$$w_2(n+1)=w_2(n)+\mu_2[e_1(n)\times(n)*\hat{s}_{12}(n)+e_2(n)\times(n)*\hat{s}_{22}(n)] \tag{3}$$

where $w_1(n)$ and $w_2(n)$ are coefficient vectors and $\mu_1$ and $\mu_2$ are the step sizes of the adaptive filters $W_1(z)$ and $W_2(z)$, respectively, and $\hat{s}_{11}(n)$, $\hat{s}_{21}(n)$, $\hat{s}_{12}(n)$ and $\hat{s}_{22}(n)$ are the impulse responses of the secondary path estimates $\hat{S}_{11}(z)$, $\hat{S}_{12}(z)$, $\hat{S}_{21}(z)$, and $\hat{S}_{22}(z)$ respectively.

The application of the 1×2×2 FXLMS algorithm to snore ANC was published in [2] and [3]. However, in these works, two microphones and two loudspeakers are located on the headboard, the disadvantages of were described above.

Example 2

Adaptive Acoustic Echo Cancellation

Figure 6:
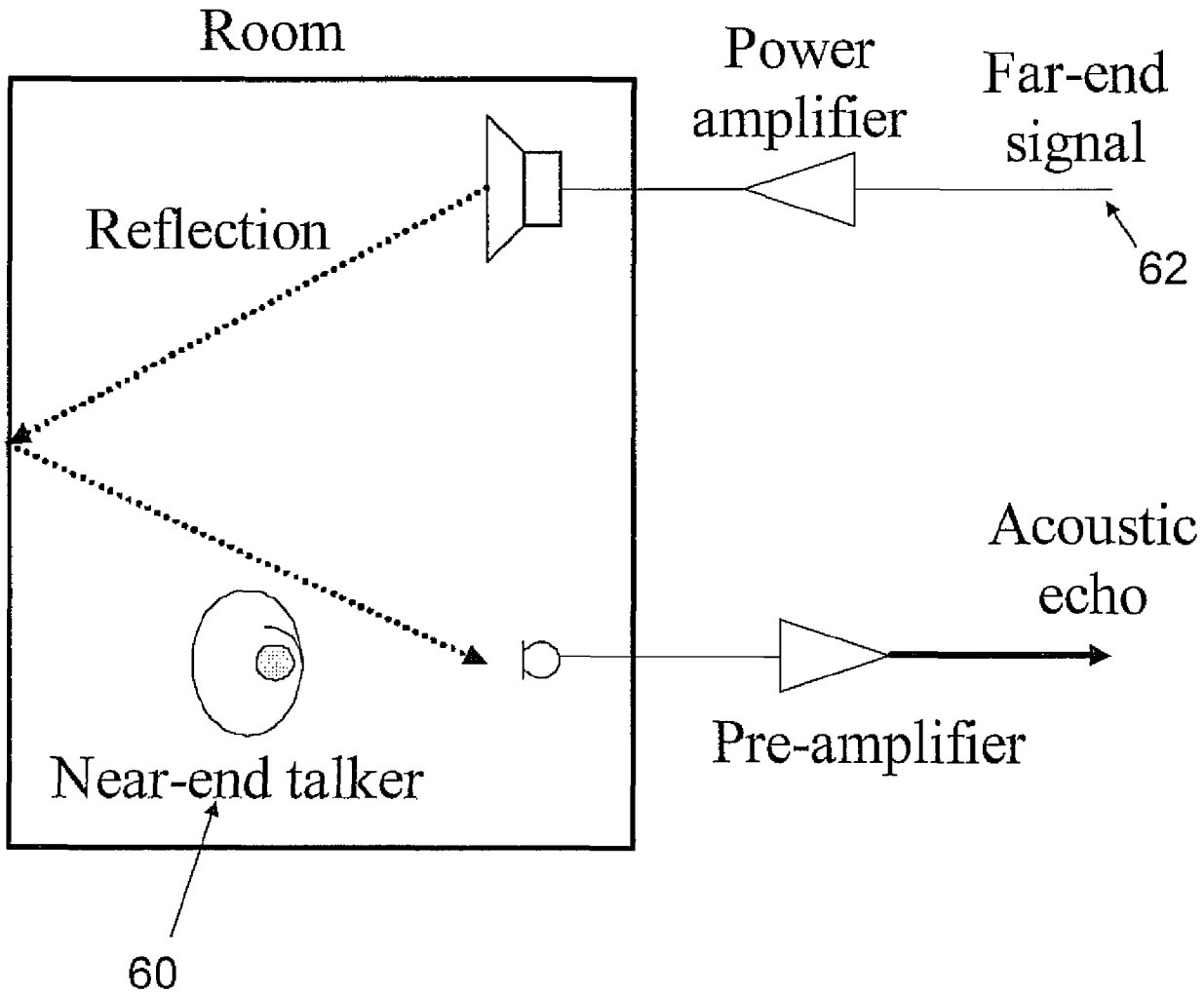
FIG. 6 is a diagram of acoustic echo generated by a speakerphone in a room.

Speakerphone or hands-free phone has become important equipment because it provides the convenience of hands-free conversation, especially for the handicapped and patients in hospital beds. For reference purposes, the person using the speakerphone is the near-end talker 60 and the person at the other end is the far-end talker 62. In FIG. 6, the far-end speech is broadcasted through one or two loudspeakers inside the pillow unit. Unfortunately, the far-end speech played by the loudspeaker is also picked up by the microphone(s) inside the pillow, and this acoustic echo is returned to the far end that annoying the far-end talker. The function of adaptive acoustic echo cancellation is to reduce this undesired echo.

Figure 7:
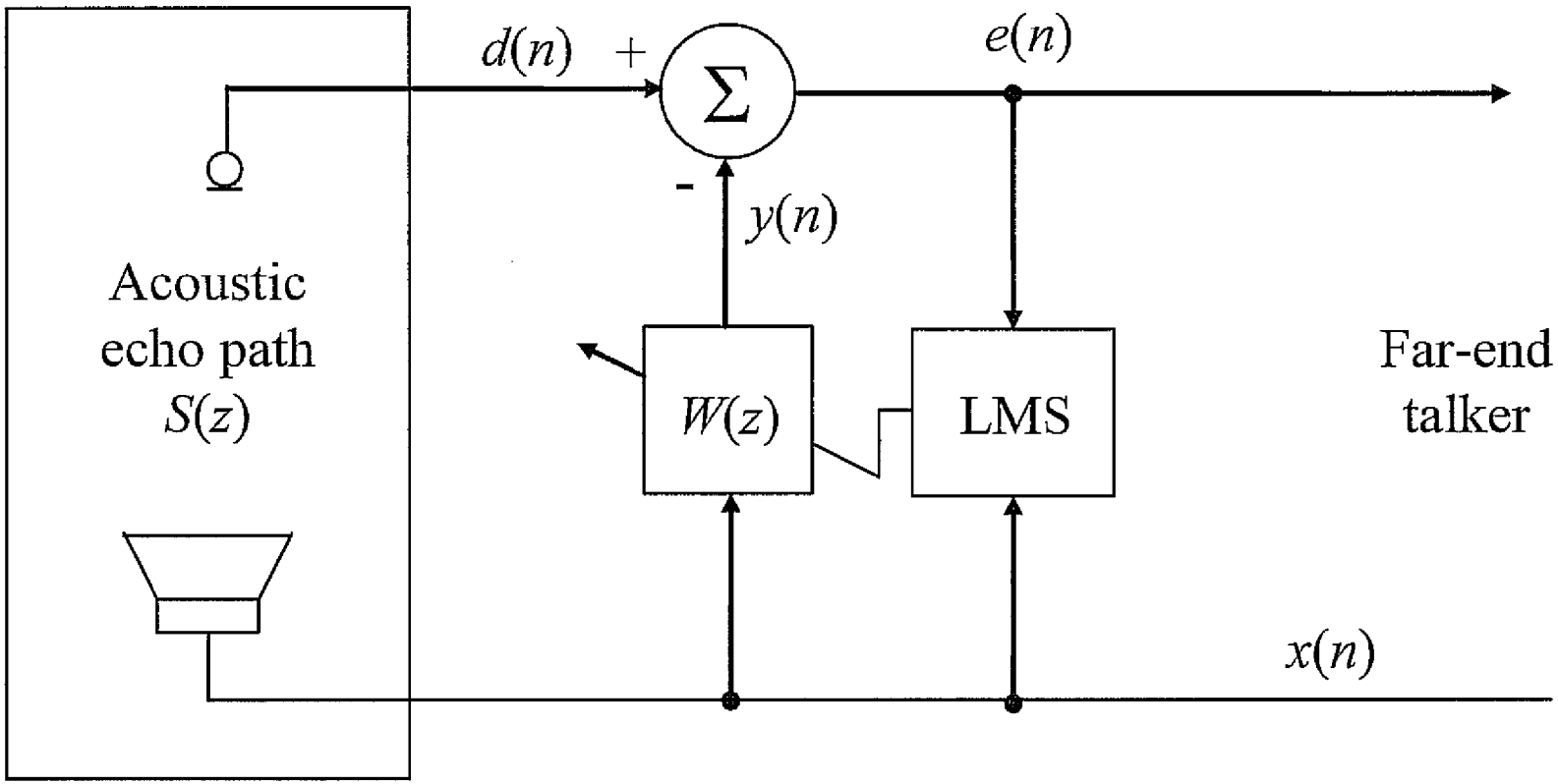
FIG. 7 is a block diagram of an acoustic echo canceller.

The block diagram of an acoustic echo canceller is illustrated in FIG. 7 [4]. The acoustic echo path S(z) includes the transfer functions of the A/D and D/A converters, smoothing and anti-aliasing lowpass filters, speaker power amplifier, loudspeaker, microphone, microphone preamplifier, and the room transfer function from the loudspeaker to the microphone. The adaptive filter W(z) models the acoustic echo path S(z) and yields an echo replica y(n) to cancel acoustic echo components in d(n). Note that this acoustic path S(z) is called the secondary path in active noise control if only one loudspeaker and one microphone inside the pillow are used. This provides an innovation of integrating acoustic echo cancellation with active noise control given in previous section.

The adaptive filter W(z) generates a replica of the echo as $$y(n) = \sum_{l=0}^{L-1} w_l(n)x(n-l). \tag{4}$$

This replica is then subtracted from the microphone signal d(n) to generate e(n). The coefficients of the W(z) filter is updated by the normalized LMS algorithm as $$w_1(n+1)=w_1(n)+\mu(n)e(n)x(n-l),\ l=0,1,\ldots,L-1, \tag{5}$$

where μ(n) is the normalized step size by the power estimate of x(n).

Example 3

Signal Processing Techniques for Efficient Recording and Non-Invasive Monitoring The most important constituent in efficient recording and non-invasive monitoring is the signal activity detector (SAD). The SAD identifies the background noise only periods so that an accurate analysis and recording of the desired signal can be done. The basic rule is that to estimate the statistics of the background noise, it is always desirable to process and record only those signal samples which have a high probability of containing no background noise. To achieve this, an adaptive energy threshold which marks the probable boundary between noise samples and noisy desired signal samples is established by monitoring the energy on a sample by sample basis.

The window length technique uses windows of different sizes like the very long window, a medium window, and a short window to detect signal activity, i.e., signal power, noise floor and detection threshold (thres). These variables are represented by sf, nf and thres. If sf>thres, then the signal samples are detected. If sf<thres, then the background noise samples are detected. Depending on whether it is the onset or offset of signal such as speech, a very long window and a medium window respectively are used to obtain the noise floor.

(1) If signal power is greater than the previous noise floor, the current status is the onset of signal (nf<sf). During the onset of signal, the noise floor nf is increased slowly by using the very long window $$nf=(1-\alpha_l)nf+\alpha_l E_n \tag{6}$$

where $\alpha_l=1/32000$.

(2) If the signal power is less than the previous noise floor, then the current status is offset of signal (nf>sf). During the offset of signal, update the noise floor nf to the current noise level fast by using the medium window $$nf=(1-\alpha_m)nf+\alpha_m E_n \tag{7}$$

where $\alpha_m=1/256$.

The threshold is proportional to the noise floor. Also there is an extra margin value called as safety margin to obtain a safe detection. The threshold is calculated as $$\text{thres}=\text{margin}+\alpha^* nf \tag{8}$$

If the present input signal strength is greater than the threshold, than the system declares the presence of signal, accordingly a short window is used to estimate the noisy signal level. In the absence of signal a long window is used to estimate the noisy signal level and noise level.

Example 4

Innovative Integration of Active Noise Control with Acoustic Echo Cancellation This example deals with developing an algorithm that integrates the acoustic echo cancellation (AEC) with the active noise control (ANC) system to provide a quiet environment for hands-free voice communications. There are two main issues with the integration of AEC to the ANC system: (i) The speech can act as interference to the ANC system and impede proper adaptation, and (ii) The ANC system can cancel the intended speech sound. These two issues necessitate the development of an integrated system that combines both functions and is cost effective. This is done by developing a method that can subtract the speech from the error signal before it is used to update the coefficients of the adaptive filter for ANC.

The algorithm is found to have a number of advantages. An important aspect is its ability to model the secondary path online. This involves the estimation of the secondary path in parallel with the operation of the ANC system. The S(z) filter is modeled through a system identification scheme. It uses speech as the reference signal and treats the secondary path as the unknown system. This makes the algorithm sensitive to time-varying secondary paths.

Each of these algorithms described above in Examples 1-4 can be used to control the electronic pillow 10 for various methods. Thus, the electronic pillow 10 can be effective for active noise control, hands-free communications, sleep monitoring and response to emergent conditions, and recording for sleep analysis.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

REFERENCES

[1] Sen M. Kuo and Dennis R. Morgan, "Active Noise Control: A Tutorial Review," *Proceedings of The IEEE*, vol. 87, no. 6, pp. 943-973, June 1999.

[2]. Sen M. Kuo and Rakesh Gireddy, "Real-Time Experiment of Snore Active Noise Control," in proceeding of *IEEE Int. Conf. on Control Applications*, October 2007, pp. 1342-1346.

[3]. Sreeram Chakravarthy and Sen M. Kuo, "Application of Active Noise Control for Reducing Snore," in *Proc. IEEE ICASSP*, May 2006, pp. V. 305-308.

[4] Sen M. Kuo, Bob H. Lee and Wenshun Tian, Real-Time Digital Signal Processing, $2^{nd}$-Ed., Section 10.6, "Acoustic Echo Cancellers," Wiley 2006.

[5]. Enzmann, et al, "Active electronic noise suppression system and method for reducing snoring noise," U.S. Pat. No. 5,844,996, December 1998.

What is claimed is:

1. An electronic pillow, comprising:

a pillow unit encasing a plurality of error microphones and a plurality of speakers;

a reference sensing unit comprising at least one reference microphone; and a controller unit, operatively coupled to the plurality of error microphones, the plurality of speakers, and the reference sensing unit, wherein the controller unit processes signals received from the plurality of error microphones and reference sensing unit to reduce noise in an area between each of the error microphones using said speakers, wherein the controller unit is configured to reduce noise utilizing a multiple-channel feed-forward active noise control and is further configured to processes signals received from at least one of the error microphones to perform acoustic echo cancellation.

2. The electronic pillow of claim 1, wherein the controller unit further comprises a digital signal processing unit operatively coupled to a phone interface, wherein said acoustic echo cancellation is performed on signals received in the phone interface.

3. The electronic pillow of claim 2, wherein the controller unit is configured to integrate the active noise control and the acoustic echo cancellation to be performed simultaneously.

4. The electronic pillow of claim 1, wherein the error microphones are embedded in a middle third of said pillow unit.

5. The electronic pillow of claim 1, wherein the controller unit comprises input channels equal to the number of error microphones and reference microphones, and output channels equal to the number of speakers.

6. The electronic pillow of claim 1, wherein the controller unit is configured to produce a sound signal to the speakers, wherein the sound comprises at least one of audio sound and anti-noise.

7. A method for abating snoring using an electronic pillow comprising a pillow unit operatively coupled to a reference sensing unit and a controller unit, the method comprising the steps of:

receiving signals via a plurality of error microphones encased in the pillow unit, wherein the error microphones are spaced a first predetermined distance from one another;

receiving at least one signal from at least one reference sensing microphone in the reference sensing unit; and processing signals received from of the error microphones and reference sensing microphone in the controller unit to reduce noise in an area between the error microphones using a plurality of speakers encased in the pillow unit, where each of the speakers are spaced a second predetermined distance from each of the respective error microphones, wherein noise is reduced in the controller unit utilizing a multiple-channel feed-forward active noise control, and wherein the controller unit processes signals received from at least one of the error microphones to perform acoustic echo cancellation.

8. The method of claim 7, wherein the controller unit comprises a digital signal processing unit operatively coupled to a phone interface, wherein said acoustic echo cancellation is performed on signals received in the phone interface.

9. The method of claim 8, wherein the controller unit integrates the active noise control and the acoustic echo cancellation to be performed simultaneously.

10. The method of claim 7, wherein the error microphones are embedded in a middle third of said pillow unit.

11. The method of claim 7, wherein the controller unit comprises input channels equal to the number of error microphones and reference microphones, and output channels equal to the number of speakers.

12. The method of claim 7, wherein the controller unit produces a sound signal to the speakers, wherein the sound comprises at least one of audio sound and anti-noise.

13. An electronic pillow, comprising:

a pillow unit encasing a plurality of error microphones and a plurality of speakers, wherein the error microphones are spaced a first predetermined distance from one another, and the speakers are each spaced a second predetermined distance from each respective error microphone;

a reference sensing unit comprising at least one reference microphone;

a controller unit, operatively coupled to the plurality of error microphones, the plurality of speakers, and the reference sensing unit, wherein the controller unit processes signals received from the plurality of error microphones and reference sensing unit using multiple-channel feed-forward active noise control and acoustic echo cancellation to reduce noise in the space between each of the error microphones using said speakers, wherein the controller unit is configured to integrate the active noise control and the acoustic echo cancellation to be performed simultaneously.

14. The electronic pillow of claim 13, wherein the controller unit further comprises a digital signal processing unit operatively coupled to a phone interface, wherein said acoustic echo cancellation is performed on signals received in the phone interface.

15. The electronic pillow of claim 13, wherein the controller unit comprises input channels equal to the number of error microphones and reference microphones, and output channels equal to the number of speakers.

* * * * *